US005484066A

United States Patent [19]

Luisi

[11] Patent Number: 5,484,066

[45] Date of Patent: Jan. 16, 1996

[54] MOUNTABLE OBJECT HOLDER

[76] Inventor: Thomas J. Luisi, c/o Vacuum Supply Co., 200 E. Main St., Bound Brook, N.J. 08805

[21] Appl. No.: 28,636

[22] Filed: Mar. 9, 1993

Related U.S. Application Data

[63] Continuation of Ser. No. 901,970, Jun. 22, 1992, abandoned.

[51] Int. Cl.[6] ..... A47F 7/00

[52] U.S. Cl. ..... 211/69.8; 211/69.9; 224/901; 248/205.3

[58] Field of Search ..... 211/69.1, 69.2, 211/69.8, 69.9, 70.6, 70.3, 70.4; 48/316.7, 316.1, 205.3; 224/42.42, 42.38, 901

[56] References Cited

U.S. PATENT DOCUMENTS

| | | | |
|---|---|---|---|
| 67,120 | 7/1867 | Jedamski | 211/69.8 |
| 689,667 | 12/1901 | Blakeslee | 211/69.9 X |
| 2,483,188 | 9/1949 | Elger | 248/316.7 X |
| 2,615,577 | 10/1952 | Bartleman | 211/70.6 |
| 2,959,296 | 11/1960 | Case | 211/69.1 |
| 4,840,341 | 6/1989 | Hasegawa | 211/89 X |
| 4,852,844 | 8/1989 | Villaveces | 248/316.7 X |
| 5,056,661 | 10/1991 | Balzano | 211/70.6 X |
| 5,080,240 | 1/1992 | Williams | 211/70.6 |

FOREIGN PATENT DOCUMENTS

| | | | |
|---|---|---|---|
| 63376 | 3/1913 | Switzerland | 211/69.8 |
| 14804 | of 1899 | United Kingdom | 211/69.8 |

*Primary Examiner*—Ramon O. Ramirez
*Assistant Examiner*—Korie H. Chan

[57] ABSTRACT

The pen and pencil holder is includes a backing having its rear or back surface typically attachable by an adhesive to an automobile dashboard, and is a unitary single plastic molded structure having a forwardly-extending spaced-apart clip structure, each clip structure having forwardly-extending opposing spaced-apart clips with each clip being substantially semicircular shaped in a horizontal plane and of substantially constant thickness in that horizontal plane. The backing structure and the clip structure and the clips thereof each have dimensions of critical ranges in order to meet the essential criteria of retained memory of flexibility while concurrently retaining appropriate strength to support a snapped-in pen or pencil within typical extreme temperature ranges encountered during hot summer weather within the confines of a closed-up automobile during daytime hours, while concurrently being non-brittle and resilient in frigid temperature of winter environment.

6 Claims, 1 Drawing Sheet

MOUNTABLE OBJECT HOLDER

This is a continuation of U.S. application Ser. No. 07/901,970 filed Jun. 22, 1992 now abandoned.

This invention is directed to a pen and/or pencil holder suitable for mounting at random location, with emphasis being given to extreme conditions endured when mounted on an automobile or truck dashboard or the like.

DISTINGUISHED PRIOR ART

While a patentability or novelty search was conducted in the United States Patent & Trademark Office Class 15, subclass 435 and Class D19 subclasses 81, 84 and 85, and Class 211, subclasses 69.1, 69.7 and 69.8, and no pertinent nor truly relevant prior art was located, art of interest includes the following. Linquist U.S. Pat. No. 3,531,072 issued Sep. 29, 1970 discloses a toothbrush holder having a continuous backing an outwardly bent at its bottom to extend as a slotted member forming horizontally flat clips of which opposite ones thereof yield in opposite upward and downward directions when a toothbrush handle is slanted when pulling the toothbrush from or when pressing it into the slot mounting-space. The Virgil Rene Galicia U.S. Pat. No. 3,946,877 dated Mar. 30, 1976 discloses a molded plastic strip of which a backing thereof is of the same height as forwardly-extending laterally spaced-apart molded clip structure of which the opposing clips are of diminishing size toward distal ends thereof ending in small knobs; between the clips adjacent the backing is a raised laterally extending wall (bottom to the slot). Barber U.S. Pat. No. 2,812,563 issued Nov. 12, 1957 discloses a support having compressed between opposite sides a convoluted resilient member forming pen and pencil mounting slots between the convolutions. Zurawin U.S. Pat. No. 4,182,455 issued Jan. 8, 1980 discloses a hollow-molded rack forming slots in which round or cylindrical cans can be inserted snugly for display or dispensing those containers. Drower U.S. Pat. No. 4,936,469 issued Jun. 26, 1990 discloses a tool rack having looped resilient members spaced-apart between which tools are mountable. Reiter U.S. Pat. No. 1,610,110 issued Dec. 7, 1926 disclosed spaced-apart bent spring wires to result in resilient loop-members between which pens and pencils may be mounted. Mikesell U.S. Pat. No. 4,875,591 issued Oct. 24, 1989 discloses a convoluted sheet forming resting or mounting positions for marking pens. Berg U.S. Pat. No. 2,591,041 issued Apr. 1, 1952 discloses a backing having mounted thereof separate spaced-apart elements each bent to form a base portion with opposite ends extending outwardly as resilient clips between which musical instrument may be mounted by musicians. Alvarez U.S. Pat. Des. No. 168,491—having no description, discloses an apparently molded combined pocket-clip and pencil holder, the strip thereof extending in a fold backwardly and parallel to a front end having two serially aligned outwardly extending elongated spaced-apart clip structures having clip arms with knobbed distal ends. Solely the Galicia patent and the Alvarez patents appear to be products of plastic molding, essential to the present invention. The Galicia patent however lacks any of the necessary backing height and lacks the required constant thickness of the oppositely-extending clips, and clip arms are not formed in a semicircular shape, the Galicia patent's clip arms being—as noted above, of diminished size in direction moving toward knobs at their distal ends, and additionally have the inner clip-space thickened base devoid of any slot. Moreover, as noted in greater detail below, neither of these patents specify the particular plastic of the present invention—noting that numerous different plastics were tried and proved ineffectual and unsatisfactory to meet essential criteria of the present invention, disclosed in detail in the invention description. The Galicia patent discloses solely the plastic as molded polystyrene for its composition—a plastic which in fact was tested and evaluated for the present invention and proved totally unacceptable and inoperative for the present invention. High impact polystyrene proved to be totally unsuitable for norm al cold conditions necessary for the present invention, the high impact polystyrene having proved at cold temperatures to be very susceptible to cracking and/or breaking at various stress points such as at the junction of the clip arms with the backing and/or the cracking or breaking-off of the clips themselves. As shall be seen from the critical limitations, including also critical dimension parameters or ranges, none of the prior art patents contemplate the essentials of the present invention nor the significance of the problems overcome by the present invention. Once the appropriate moldable plastic(s) is/are ascertained, thereafter the operable shapes and dimensions had to be ascertained, the present invention defining such, beyond which the invention is in fact inoperative—none of which are dealt with by any of the prior art patents.

BACKGROUND OF THE INVENTION

The present invention was developed by extensive testing of alternate plastics, shapes, dimensions, and the like over a period of at-least four or more years, in order to arrive at the present operable invention for the inventive pen and/or pencil holder suitable for mounting on a dashboard within a car or truck or the like subject to vast or broad variations in temperature during summer and winter in an often closed vehicle. Many plastics were tested—numerous ones of which the list of names were eventually lost, but some of which where found to be totally unacceptable; including the above-noted polystyrene, and PVC (polyvinyl chloride), and ABS (a type of styrene plastic), and polyester plastic, and polyethylene plastic—none of which could be adequately nor successfully used for the present invention. For example, the PVC was inoperative under hot weather conditions—being subject to deterioration, as well as being too brittle and subject to cracking and shearing in cold weather. ABS proved to be too hard and brittle, lacking sufficient flexibility or resiliency—leading to cracking, breaking and/or failure to resiliently expand or bend for mounting or dismounting a pen or pencil. Polyester proved entirely too soft to properly function for the present invention. Polyethylene was somewhat workable but proved to be much too flexible as a whole, within the necessary broad range of temperature conditions including very high temperatures of exposure essential to the present invention, thus such plastic being acceptable for less stringent temperature conditions, but clearly not preferred. These are merely a minor few examples of numerous plastics found to be unacceptable for the present invention, indicating conclusively that the present invention is not obvious subject matter and that there is no prior art that appreciates the problems and difficulties encountered, apart from failing to suggest or teach solutions thereto embodied in the present invention.

OBJECTS OF THE INVENTION

Accordingly, objects of the present invention include the avoiding and overcoming of problems and difficulties of the type discussed above, together with obtaining novel advantage heretofore unknown and unavailable.

Another object is to obtain a pen and/or pencil holder suitable for durability under a wide range of hot and cold environmental conditions typical of a closed vehicle in the summer and a closed or open vehicle during winter conditions.

Another object is to obtain a pencil and/or pen holder providing for easy and quick mounting and dismounting of a pen or pencil thereon at any temperature within a broad range, devoid of difficulty in either the mounting or dismounting effort and devoid of likelihood of knocking-down the holder or mutilating it or accidentally cracking or breaking it.

Another object is to obtain a pencil and/or pen holder providing for secure holding of a mounted pen and/or pencil thereby throughout a broad temperature range encompassing very hot and very cold environmental conditions.

Another object is to obtain a pencil and/or pen holder fulfilling one or more prior objects, at a low cost of manufacture, such that price to the public is nominal and affordable, while achieving one or more of foregoing objects.

Another object is to obtain a pencil and/or pen holder of simple design for both mounting and using thereof in a typically back-mounted state typically by adhesive composition applied to its rearward face of the backing structure thereof, while achieving one or more of foregoing objects.

Another object is to obtain a pencil and/or pen holder of a design and shape attractive to potential customers and users thereof, as opposed to being an eye-sore, together with the achieving of one or more foregoing objects.

Other objects become apparent from the preceding and following disclosure.

Objects of the invention are obtained by the invention as described herein.

BROAD INVENTION

In its most generic sense, this invention as below defined embodies a plurality of critical elements and parameters thereof, essential to the proper performance of the invention, as evidenced by extensive experimentation over an extended period of years, resulting in the present invention. The support is adaptable for use of any one or more of pens and/or pencils, including larger sizes for magic markers and the like. A principal intended place of use of the present invention being mounting thereof onto the face of an automobile or truck dashboard, subject to all of the conditions of summertime closed windows and wintertime frigid temperatures, the invention being critically required to be operable throughout such .range of temperatures in its required durability against deterioration, cracking, and breaking while concurrently critically retaining essential required: flexibility to successfully continue to perform in the shape of resilient paired clips mounted on and a part of the molded backing thereto utilized for mounting on the dashboard or the like. While there is also provided as a part of the combination an appropriate structure and/or elements and mechanism thereof for the mounting of a backing structure thereof onto a dashboard or wall or desk surface or the like—such as a latex or other adhesive coating on or covering the rear or back surface of the backing structure or such as one or more nail or tack/nail/screw apertures therein or a top-mounted hanging loop or the Like, the such mounting structure(s) or elements while being used as a part of or adjoined thereto, does not nor do not constitute a part of the inventive combination. Accordingly, the invention, characterized as a pen and pencil holder, as a combination of interrelated elements and parameters and/or properties thereof basically includes as its bare essentials:

1) a single or unitary integral molded one-piece composite as critically molded plastic inclusive of the backing structure thereof and the clip structure(s) extending from the front face thereof as spaced-apart clips;

2) the backing structure, as further defined below;

3) forwardly-extending clip structure(s), each clip structure having opposing clips, all as further defined below;

4) critically shaped spaced-apart clips having critical height and thickness dimensions;

5) critical backing structure shape and width, height and thickness dimensions thereof; and 6) a critical combination of the foregoing such that resilient clips have predetermined strength as to retain a pen or pencil when clipped-in thereby.

More particularly, for the inventive support mountable pen or pencil holder, there is included as a part of the combination, a planar backing structure of molded plastic. The planar backing structure has an elongated width with a substantially flattened back face and with a substantially flattened front face. The front face has critically as a continuing part of the molded plastic a plurality of forwardly extending clip structures with the molded plastic planar backing structure. Separate metallic or other separately mounted clip fall to perform adequately nor successfully. Each forwardly extending clip structure extends from a junction point on said flattened front face as paired spaced-apart forwardly-extending clips arching substantially critically semicircular along substantially identical forwardly-extending clip lengths as spaced-apart semicircular shaped dips. The paired spaced-apart clips each critically have a substantially constant thickness in a horizontal plane of a first dimension critically ranging from about 1/32 inch up to about 5/16 inch, and substantially constant clip height in a vertical plane of a second dimension ranging critically from about 1/16 inch up to about 6 inches. The backing structure has a backing height of a third dimension critically ranging from a minimum of about ½ inch. The backing height of the third dimension is critically at-least equal to height of any one of the plurality of the clip. The backing structure has the elongated width as a horizontal fourth dimension of critically at-least twice a single one of the paired spaced-apart forward clips and critically ranges up to at-least equal to combined widths of the plurality of the clips. The backing structure has a thickness of a fifth dimension ranging critically from a minimum thickness of about 1/32 inch up to a maximum thickness of critically about 1.5 inch. The molded plastic planar backing structure and the continuing composition are a molded plastic composition having a predetermined composition critically characterized by a retention of predetermined resiliency and resiliency memory and durable strength arising from a combination of the molded plastic together with the first, second, third, fourth and fifth dimensions such that the paired spaced-a part forwardly-extending clips are not too loose in clipping onto an inter-spaced pen or pencil as to fall to retain the pen or pencil and such that the paired spaced-apart forwardly-extending clips are sufficiently non-fragile as to break or crack when inserting a pen or pencil into or out of inner-space between the paired spaced-apart forwardly-extending clips within a suitable minimum temperature range of from at-least as low as (or lower than) about 70 degrees up to at least as high as (or higher than) about 90 degrees Fahrenheit.

In a first preferred embodiment, the support mountable pen or pencil holder of the broad inventive combination, the molded plastic is selected from the group consisting of polypropylene and ethylene copolymer of polypropylene.

In a second preferred embodiment as an improvement on the first preferred embodiment, each of the spaced-apart semicircular shaped clips has an outer convex surface and an inner concave surface along its length. The outer convex surface at the junction point forms an acute angle with and relative to the flattened front face such that each the spaced-apart semicircular shaped clips has enhanced flexibility and diminished propensity to snap-off or break during flexing thereof when inserting or removing a pen or pencil to or from space between paired ones of the spaced-apart semicircular shaped clips.

In a third preferred embodiment as an improvement on the second preferred embodiment, between the inner concave surfaces of each pair of the spaced-apart semicircular shaped clips at the junction point, there is formed a slot critically extending through the inner concave surface in a direction substantially vertically toward the flattened front face at the above-described junction point such that each the spaced-apart semicircular shaped clips has enhanced flexibility and diminished propensity to snap-off or break during flexing thereof when inserting or removing a pen or pencil to or from space between paired ones of the spaced-apart semicircular shaped clips.

In a fourth preferred embodiment, as an improvement on the third preferred embodiment, the paired spaced-apart clips each having a substantially constant thickness in a horizontal plane of the first dimension critically ranging from about 3/64 inch up to about 5/32 inch as required dimensions for sufficient but not too unyielding sturdiness or pen/pencil retaining capability and a substantially constant clip height in a vertical plane of the second dimension critically ranging from about ¼ inch up to about ¾ inch, as a second variable critical for the same reason; the backing structure has a height as the third dimension critically ranging from a minimum of about ½ inch to a maximum height of about ¾ inch—critically necessary for sufficient strength as to avoid becoming sagged and/or floppy and/or too flexible to successfully snap-in and/or snap-out a pencil or pen to or from a clipped state, and has a thickness as the fifth dimension critically ranging from a minimum thickness of about 6/128 inch up to a maximum thickness of about 3/32 inch, also critical for the same foregoing reason. The molded plastic planar backing structure and the continuing corn position are a molded plastic composition having a predetermined composition characterized by a retention of predetermined resiliency and resiliency memory and durable strength arising from a critical combination of the molded plastic together with the above-noted first, second third, fourth and fifth dimensions such that the paired spaced-apart forwardly-extending clips are not too loose in clipping onto an inter-spaced pen or pencil as to fail to retain the pen or pencil and such that the paired spaced-apart forwardly-extending clips are not too loose in clipping onto an inter-spaced pen or pencil as to fail to retain the pen or pencil and such that the paired spaced-apart forwardly-extending clips are sufficiently non-fragile as to break or crack when inserting a pen or pencil into or out of inner-space between the paired spaced-apart forwardly-extending clips within a typical suitable minimum temperature range of from typically as low as about minus—40 degrees Fahrenheit and as high as a typical maximum 220 degrees Fahrenheit.

In a fifth preferred embodiment as an improvement on the fourth preferred embodiment, the backing structure has a height as the third dimension of critically at least about ½ inch when the clip height as the second dimension is between about 1/16 inch to about ¼ inch, for the same supporting reasons as above-stated for the backing structure height.

In a sixth preferred embodiment as an improvement on the fifth preferred embodiment, the molded plastic includes at-least substantially (i.e. predominantly) ethylene copolymer of polypropylene, as critical to the obtaining of the preferred physical properties and/or characteristics previously described above, in order to embody improved increased sturdiness and/or pen or pencil holding ability under high or higher temperatures that normally would tend to soften or too greatly increase flexibility of plastic such as solely polypropylene. However, polypropylene is normally more than adequate for foregoing conditions set-forth for the combination of this invention, although the ethylene copolymer is more adequate when excessively high temperatures are contemplated.

In a seventh preferred embodiment as an improvement on the sixth preferred embodiment, the molded plastic critically includes a predetermined minor but critical amount of solid pigment matter sufficient to impart each of color and enhanced strength against breaking or shearing when inserting or removing a pen or pencil to or from space between paired ones of the spaced-apart semicircular shaped clips, in order to obtain upgraded (increased) toughness (pen or pencil holding ability such as during high/elevated temperatures) while remaining adequately resilient. The amount of pigment added is governed by the particular plastic utilized and/or the intensity of coloring desired. The benefits of such addition are somewhat comparable to the use of the copolymer as to a monomer plastic.

In a another preferred embodiment as an improvement on any one or more of preceding embodiments, latex adhesive is applied to a rearward face of the backing structure, enabling easy and effective and quick mounting of the inventive holder devoid of mutilation or danger thereof to the mounting surface.

In a still another preferred embodiment, the pen and/or pencil holder includes a plurality of the clip structures, each with its opposing clip or clip arms as previously described, together with one or more of the plurality differing in inside diameter of the clip-space as compared to remaining others of the clip structures, thereby enabling the mounting of pens and/or pencils of differing cross-sectional sizes. Thereby the value of the holder is enhanced, since not all pens and pencils have the same diameter.

The foregoing various critical features of the combination have been tailored (arrived-at) and repeatedly confirmed by extensive experimentation by the inventor over a period of years in arriving at the present invention.

The invention may be better understood by making reference to the following drawings.

DETAILED DESCRIPTION

Figure 1:
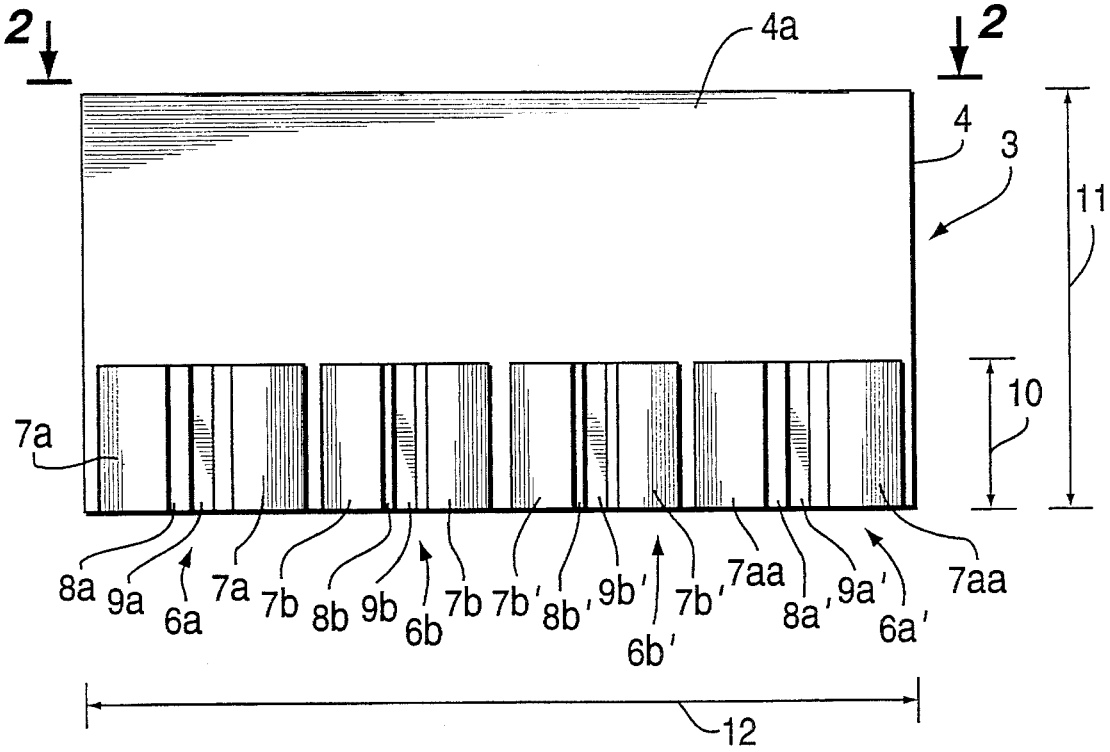
FIG. 1 diagrammatically illustrates a front view of the entire pen and pencil molded plastic holder.
Figure 2:
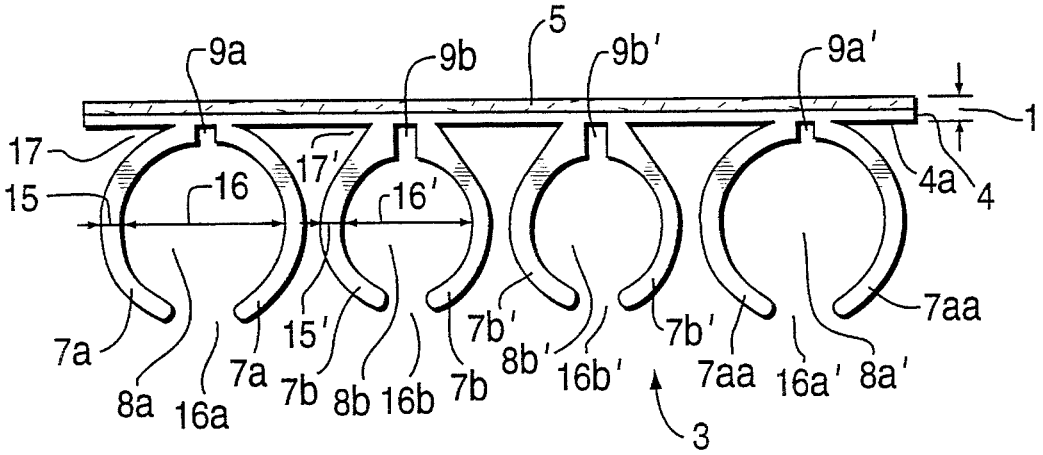
FIG. 2 diagrammatically illustrates a cross-sectional view of the entire pen and pencil molded plastic holder, as taken along lines 2—2 of FIG. 1.

FIGS. 1 and 2 are different views of the same embodiment and are only a typical illustration of many variations in dimensions provided for in the foregoing description.

Accordingly, for common elements illustrated in both Figures, identical indicia are utilized, and once described for one figure, description is not thereafter repeated for the other figure except in certain instances for purposes of clarity and/or improving understanding.

FIGS. 1 and 2 show different views of the pen and pencil molded plastic holder 3. Accordingly, FIGS. 1 and 2 each illustrate a preferred embodiment of the pencil and pen holder 3.

FIG. 1 in the front-side view thereof, illustrates the backing structure 4 having the forward or front face 4*a* thereof. Also shown are the large-sized forwardly extending clip structures 6*a* and 6*a'* adapted for snapping-in and holding of larger sized pencils or pens, and smaller sized forwardly extending clip structures 6*b* and 6*b'* each extending forwardly from the continuing molded plastic junction points (locations) described below for FIG. 2. Also shown forward-most faces of the forwardly extending spaced-apart semicircular shaped opposing clips—both identified merely as the clips 7*a* above-noted, and as the paired clips 7*aa* , and the paired clips 7*b*, and the paired clips 7*b*'. Also viewable are the slots at the inner-space base of the forwardly extending clip structures, such as slots 9*a*, 9*b*, 9*a'* and 9*b'*. The height of the various clips is illustrated a height 10. Height of the backing is illustrated as backing height 11. The width of the backing structure is illustrated as backing structure width 12.

FIG. 2, in a cross-sectional top view of FIG. 1, shows the same features above described from that angle of observation. Additionally, there is shown the inner clip mounting space 8*a*, 8*b*, 8*a'* and 8*b'*, defined (formed) between the opposite semicircular clips above-described, as viewed in FIG. 2 as having constant thickness 15 for each of opposite clips 7*a* and 7*aa*, and constant thickness 15' for each of opposite clips 7*b* and 7*b*'. Clip-end gaps are shown and identified as gaps 16*a*, 16*a*', 16*b* and 16*b'* with inner diameters 16 for larger space 8*a*and 16' for smaller space 16'. At the base of each forwardly extending clip structures are undercuts 17 for the larger clip structure semicircular clips 7*a* and 7*aa* , and undercut 17 ' for the smaller sized semicircular clips 7*b* and 7*b* '. Also view able in FIG. 2 is the layer 5 of adhesive such as latex or or other adhesive as might be desired, having a thickness 13. The backing has a thickness 14. Slots 9*a*, 9*b*, 9*b'* and 9*a'* are more discernibly illustrated as to their position and shape, previously described for FIG. 1. Also, the constant and uniform widths of the respective semicircular clips 7*a*, 7*b*, 7*b*' and 7*aa* are clearly illustrated in FIG. 2.

The preceding identifications of elements now gives meaning to the preceding broad description as to the same elements and former described functions thereof.

In use of the holder of this invention, preferably an adhesive back holder such as here illustrated in FIGS. 1 and 2, is positioned with the adhesive backing facing a mounting surface such as a dashboard, and pressed thereagainst to adhere and mount the pencil and pen holder onto the dash board. Thereafter, an upright pencil or pen of corresponding and substantially matched size will be pressed through the slot 16*a* or 16*b* or 16*b*' or 16*a'*, into the space 8*a* or 8*b* or 8*b'* or 8*a'* with the resilient clips 7*a* or 7*b* or 7*b*' or 7*aa* become supported by the pressure of the particular opposite arms pressing thereagainst until the pen or pencil is subsequent forcefully pulled away through the same gap through which it was originally mounted.

It is within the scope of the present invention to make such variations and/or modifications and/or substitution of equivalents as would be within the skill of an ordinary artisan in this field of technology or art.

I claim:

1. A holder comprising a) a rigid molded polypropylene or polypropylene-ethylene copolymer plastic planar support plate having a frontside and a backside;

b) a layer of adhesive on the backside of said support plate;

c) a plurality of paired, coactively operable fingers open at one end for holding an object having a circular cross section extending outwardly from the frontside of said support plate and molded integrally therewith at junctions along said frontside of said support plate, said finger pairs defining a circular cross section therebetween of variable size; and having a slot of variable size opposite said open end and at said junction for providing flexibility and stress relief to said fingers, whereby when a pen or pencil is snapped in or out of said fingers, said slot permits said fingers to open to afford entry or exit of said pen or pencil without stressing the plastic fingers, and to close again to their original position.

2. A holder according to claim 1 wherein pairs of fingers have a different size cross section.

3. A holder according to claim 1 wherein said plastic retains its properties over a temperature range of from about –40° F. to about 220° F.

4. A holder according to claim 1 wherein said plastic contains a filler and/or pigment in an amount sufficient to impart added strength and/or color to said plastic.

5. A holder according to claim 1 wherein the size and depth of the slot between each pair of fingers varies with the size of the opening between the fingers to accommodate different sizes of pen of pencil without breaking.

6. A holder according to claim 1 wherein said fingers have a uniform thickness.

* * * * *